US008096234B2

(12) United States Patent
Rivard

(10) Patent No.: US 8,096,234 B2
(45) Date of Patent: Jan. 17, 2012

(54) APPARATUS AND METHOD FOR WOOD MULCH BALES

(75) Inventor: Michael Rivard, Cedar, MN (US)

(73) Assignee: Eco Bales LLC, East Bethel, MN (US)

( * ) Notice: Subject to any disclaimer, the term of this patent is extended or adjusted under 35 U.S.C. 154(b) by 0 days.

(21) Appl. No.: 12/502,405

(22) Filed: Jul. 14, 2009

(65) Prior Publication Data

US 2010/0011717 A1 Jan. 21, 2010

Related U.S. Application Data

(60) Provisional application No. 61/080,337, filed on Jul. 14, 2008.

(51) Int. Cl.
*B30B 13/00* (2006.01)

(52) U.S. Cl. ..... 100/35; 53/436; 53/528; 206/83.5

(58) Field of Classification Search ..... 206/83.5, 206/598, 428, 442, 597; 220/770, 754; 217/66, 217/68; 53/436, 528; 100/35, 41
See application file for complete search history.

(56) References Cited

U.S. PATENT DOCUMENTS

| | | | | | |
|---|---|---|---|---|---|
| 112,140 | A | * | 2/1871 | Hadwin | 206/83.5 |
| 123,824 | A | * | 2/1872 | Hadwin | 206/442 |
| 169,518 | A | * | 11/1875 | Brown | 206/83.5 |
| 3,153,491 | A | * | 10/1964 | MacTavish et al. | 220/770 |
| 3,252,737 | A | * | 5/1966 | Seaton | 297/462 |
| 3,337,326 | A | * | 8/1967 | Nadler, Jr. et al. | 71/26 |
| 3,541,752 | A | * | 11/1970 | Ness | 53/436 |
| 4,036,359 | A | * | 7/1977 | Strickland, Jr. | 206/83.5 |
| 4,817,797 | A | * | 4/1989 | Hamelin | 206/428 |
| 4,991,498 | A | | 2/1991 | McCurdy | |
| 5,392,912 | A | * | 2/1995 | Grubbs | 206/451 |
| 5,623,811 | A | * | 4/1997 | Hirschek et al. | 53/436 |
| 6,390,729 | B1 | | 5/2002 | Dooley | |
| 6,402,426 | B1 | | 6/2002 | Dooley | |
| 6,729,068 | B2 | | 5/2004 | Dooley | |
| 2005/0223671 | A1 | * | 10/2005 | Korman et al. | 52/607 |
| 2009/0077920 | A1 | * | 3/2009 | Korman et al. | 52/606 |

FOREIGN PATENT DOCUMENTS

GB 2110637 A * 6/1983

OTHER PUBLICATIONS

"High Density Horizontal Baler Bagger" Beco Baler Equipment, News realease Dec. 1988, The Gale Group.*

"Email from tbroderick@forestconcepts.com to Receptionist@slwip.com, dated Jul. 15, 2010", 1 pg.

(Continued)

*Primary Examiner* — David Fidei

(74) *Attorney, Agent, or Firm* — Schwegman, Lundberg & Woessner. P.A.

(57) ABSTRACT

The present subject matter provides methods and apparatus for packaging wood mulch. Examples include a wood mulch bale produced using a method comprising compressing wood mulch at a pressure of between 12,000 pounds and 60,000 pounds to form a volume of compressed wood mulch and disposing a band about the compressed volume of wood mulch, wherein the compressed volume of wood mulch is between about 3000 cubic inches and about 5400 cubic inches. Other variations are provided herein.

20 Claims, 20 Drawing Sheets

OTHER PUBLICATIONS

"Vineyards & Wineries, Premium Wood Strand Erosion Control Mulch", Product Brochure, www.woodstraw.com, downloaded on or about Oct. 25, 2010, 1 pg.
"Website: WOODSTRAW Wood Strand Erosion Control Mulch by Forest Concepts", www.woodstraw.com, downloaded on or about Oct. 25, 2010, 2 pgs.
"WOODSTRAW ECM, Engineered Erosion Control Mulch", Technical Specification, Model LS64-100, www.woodstraw.com, downloaded on or about Oct. 25, 2010, 1 pg.
"WOODSTRAW, Mt. West Helicopters: A great combination for all aerial treatments of erosion control", Product Brochure, www.woodstraw.com, downloaded on or about Oct. 25, 2010, 1 pg.
"WOODSTRAW, Wood Strand Erosion Control Mulch", Product Brochure, www.woodstraw.com, downloaded on or about Oct. 25, 2010, 1 pg.
"WOODSTRAW, Wood Strand Erosion Control Mulch; Wind—A Problem, Dust—A Problem, The Solution", Product Brochure, www.woodstraw.com, downloaded on or about Oct. 25, 2010, 1 pg.

* cited by examiner

APPARATUS AND METHOD FOR WOOD MULCH BALES

CLAIM OF PRIORITY

This application claims the benefit under 35 U.S.C 119(e) of U.S. Provisional Patent Application Ser. No. 61/080,337, filed Jul. 14, 2008, which is incorporated herein by reference in its entirety.

TECHNICAL FIELD

This document relates generally to packaging of wood mulch and more particular to apparatus and methods for wood mulch bales.

BACKGROUND

Wood mulch is produced by machines that shred wood to make piles of shredded mulch. Shredded mulch can be used for landscaping, an evaporation barrier, and water erosion prevention, among other uses. For landscaping jobs using mulch, the mulch is typically purchased in large bags or for larger jobs a large load of mulch is dumped at the worksite. Such dumps generally are done near the street where a truck can dump the mulch. The mulch is then transported to the desired area of application by wheelbarrow, bobcat, or some other type of equipment. The mulch is ultimately spread out over the region to be landscaped.

Thus, the shipment of mulch is complicated by the need for large transport beds, such as pickups or dump trucks. The placement of the mulch is further complicated by multiple trips from the dump pile to the exact deposit sites, which can destroy the landscape over which the mulch is transported. The movement of the mulch to the proper location is generally must be done as soon as possible because the dump site can be on a street or driveway that cannot be blocked for long periods of time.

There is a need in the art for improved ways to package and deliver mulch to worksites. The mulch should be package in convenient ways to facilitate transport. Such packaging should be inexpensive. If possible, the packaging should be environmentally friendly to avoid polluting the environment.

SUMMARY

This document provides apparatus and methods for bales of compressed volumes of landscape material such as shredded wood mulch.

In one example, a wood mulch bale is produced using a method comprising compressing wood mulch at a pressure of between 12,000 pounds and 60,000 pounds to form a volume of compressed wood mulch and disposing a band about the compressed volume of wood mulch, wherein the compressed volume of wood mulch is between about 3000 cubic inches and about 5400 cubic inches.

In one example, a wood mulch apparatus includes compressed wood mulch having a compressed volume of between about 3000 cubic inches and about 5400 cubic inches, and a band disposed about the compressed volume of mulch and adapted to substantially maintain the mulch in the compressed volume.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

This present subject matter relates to packaging wood mulch.

Figure 1A:
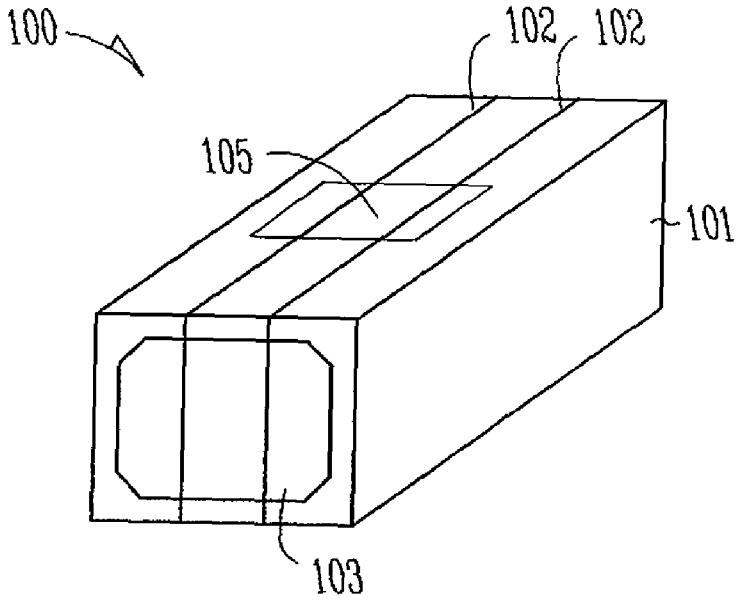
FIG. 1A shows a perspective view of a mulch bale according to one embodiment of the present subject matter.
Figure 1B:
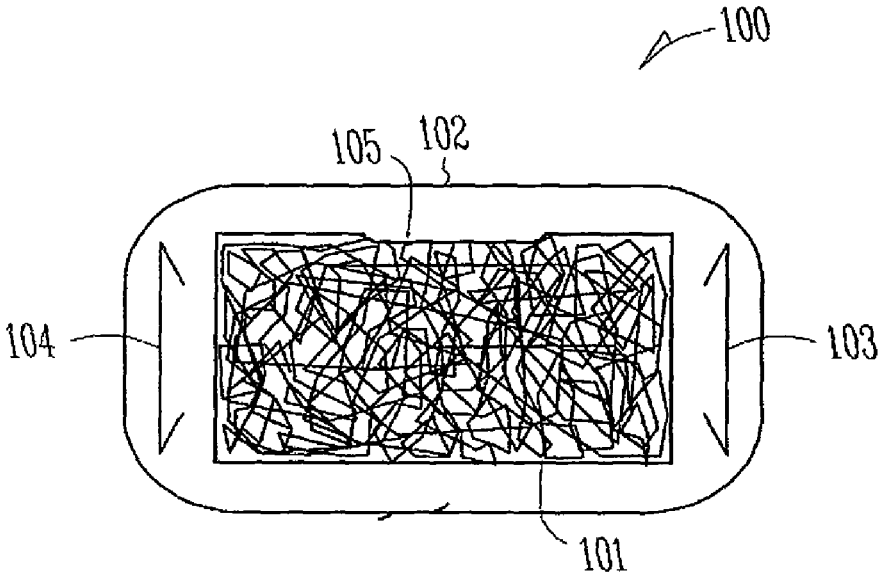
FIG. 1B shows an exploded view of a mulch bale according to one embodiment of the present subject matter.

Mulch, as well as other landscape materials, is available for purchase in a variety of forms. For example, mulch, sand, black dirt and stones can be purchased in bulk, in boxes and in bags. Depending on the quantity required, one packaging method may be more cost effective and/or labor effective than another. Compressed bales of mulch provide an alternative, space-saving packaging that can be much more beneficial for the sale of mulch to both consumers and retailers than other methods of packaging and distributing mulch. Compressed bales of mulch provide additional benefits. One enhancing aspect of compressed mulch bales is the compressed, compact size. Compressed bales allow more mulch to be transported in a given volume of space. In various embodiments, 90 yards of mulch can be stored in an 8'×20' area when the bales are stacked three high. A pickup truck with a typical 8' bed is capable of transporting 9 yards of mulch at one time. In various embodiments, a compressed mulch bale measuring about 24 inches long, 14 inches high and 14 inches deep (2.72 cu. ft.) contains enough mulch to cover a 27 $ft^2$ area 3 inches deep, or about 0.25 cu. yd. In some embodiments, a compressed mulch bail measuring about 16-21 inches long, 14 inches high and 14 inches deep, contains about ⅙ cu. yd. of mulch. FIG. 1A shows a perspective view of a mulch bale 100 according to one embodiment of the present subject matter. FIG. 1B shows an exploded view of a mulch bale 100 according to one embodiment of the present subject matter. The bale 100 includes compressed mulch 101 in a small rectangular cube. Various types of shredded wood mulches can be baled. Examples of mulch types suitable for compressed baling include, but are not limited to, Western Red Cedar, Cypress, Premium Hardwood. Such mulches include, but are not limited to colored mulches including CoCo Brown, Brick Red, Forest Brown, Royal Gold, Jet Black, and Cedartone.

Banding material 102 holds the mulch bale 100 together. In various embodiments, two bands of banding material 102 hold the bale together. Various plastic banding materials can be used. Banding materials include those rated for about 700 lbs break tension and that exhibit low elongation under pressure. Such banding enhances the appearance and handling of the compressed bale. In various embodiments, each plastic strap is a flat, ⅝" wide strap. Other strap materials, sizes and numbers are possible without departing from the scope of the present subject matter.

In various embodiments, bale 100 includes a layer of sheet material, a retainer sheet 103, at opposing ends of the bale. In various embodiments, the sheet material 103 is cardboard. Using cardboard reduces the plastic content of the package. Less plastic packaging makes the mulch packaging more eco-friendly than conventional mulch bags. For example, 1 cubic yard of baled mulch includes 3.5 oz. of plastic. In contrast, one cubic yard of bagged mulch can include 2.4 pounds of plastic packaging. In some embodiments, the sheet material 103 is a square or rectangular piece of cardboard substantially the size of each banded end of the bale. In various embodiments, the corners of the cardboard are cut to conform to the rounded comers of a baler machine such as those discussed below. In some embodiments, the edges of the sheet material are folded 104 to add strength to the sheet material and reduce water from entering the compressed bale. The retainer sheet also distributes the pressure between the banding and the compressed mulch over a larger area such that the banding does not appear to dig into the mulch. In various embodiments, the double-layered edge 104 of the retainer sheet adds strength to reduce tearing of the retainer sheet where the banding extends from the retainer sheet.

Figure 2:
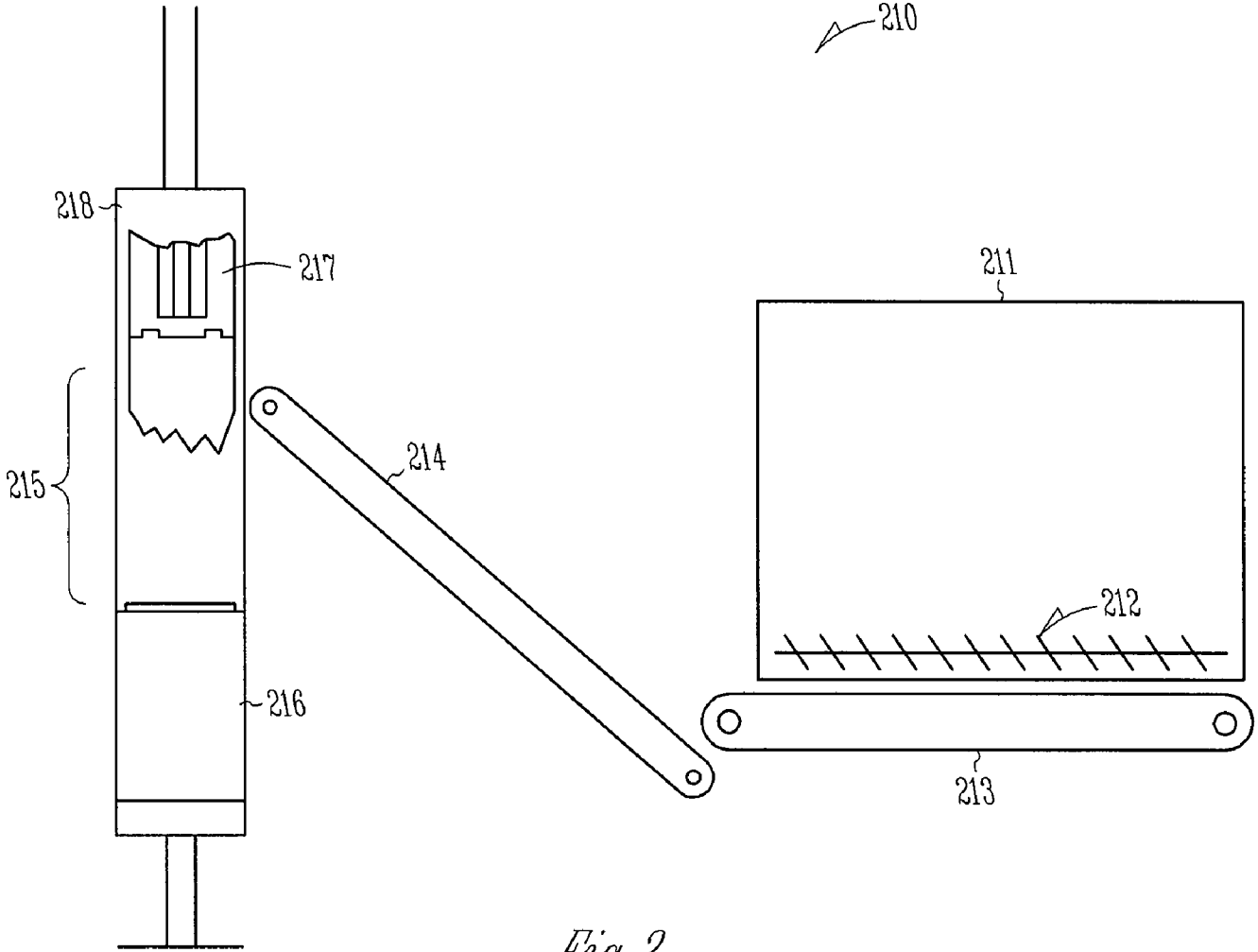
FIG. 2 shows a baling machine for making compact, compressed bales of mulch according to one embodiment of the present subject matter.

FIG. 2 shows a baling machine 210 for making compact, compressed bales of mulch according to one embodiment of the present subject matter. The machine includes a feed hopper 211 with an auger 212, a feed hopper conveyor 213, a fill conveyor 214, a fill chamber 215 and a compression chamber 216. FIG. 2 also shows a cut-away view of a hydraulic compression ram 217 enclosed in a large gage, tubular steel housing 218. The housing 218 also encloses the fill chamber 215 and at least part of the compression chamber 216. In various embodiments, the machine includes a controller to automate one or more functions.

In one embodiment, the machine includes an indicator near the top of the compression chamber. The operator uses the indicator as reference for loading mulch into the compression chamber. For example, after loading a piece of cardboard into the compression chamber, the operator turns on the conveyor to load mulch into the compression chamber. The operator will stop the conveyor when the level of the mulch in the chamber is at or near the same level as the indicator. In various embodiments, a controller uses a sensor to control the amount of material loaded into the compression chamber. The operator starts loading mulch into the compression chamber using the fill conveyor. As the chamber fills, the sensor indicates the level to the controller. When the sensor indicates the chamber is full, the controller stops the fill conveyor. In various embodiments, the sensor provides a single discrete input to the controller. In some embodiments, the sensor provides a real time value of the fill level of the compression chamber. Such a sensor allows the controller to be programmed with variable fill levels for making various sized bales using the same machine.

Figure 3:
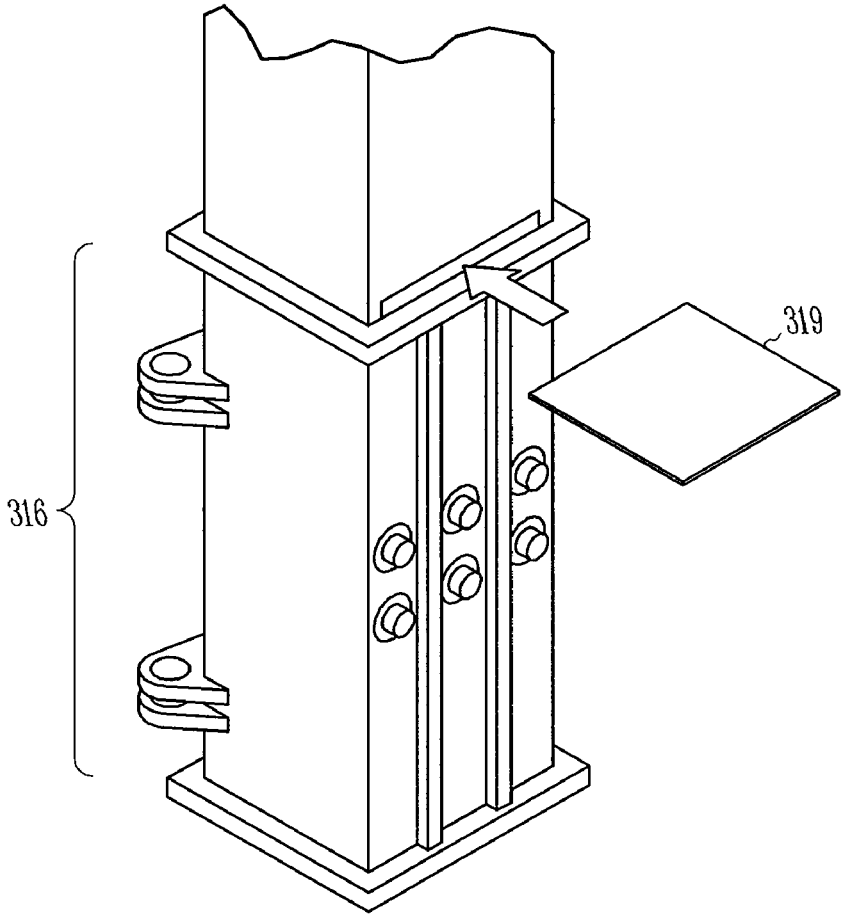
FIG. 3 shows an operator sliding cardboard sheet material into the baler after filling the compression chamber to the top.

FIG. 3 shows an operator sliding cardboard sheet material 319 into the baler after filling the compression chamber 316. After sliding the cardboard 319 into the baler, the operator compresses the landscape material using controls for the hydraulic ram. In various embodiments, the hydraulic ram compresses the mulch with about 60,000 lbs. of pressure. Other pressures are possible without departing from scope of the present subject matter.

Figure 4:
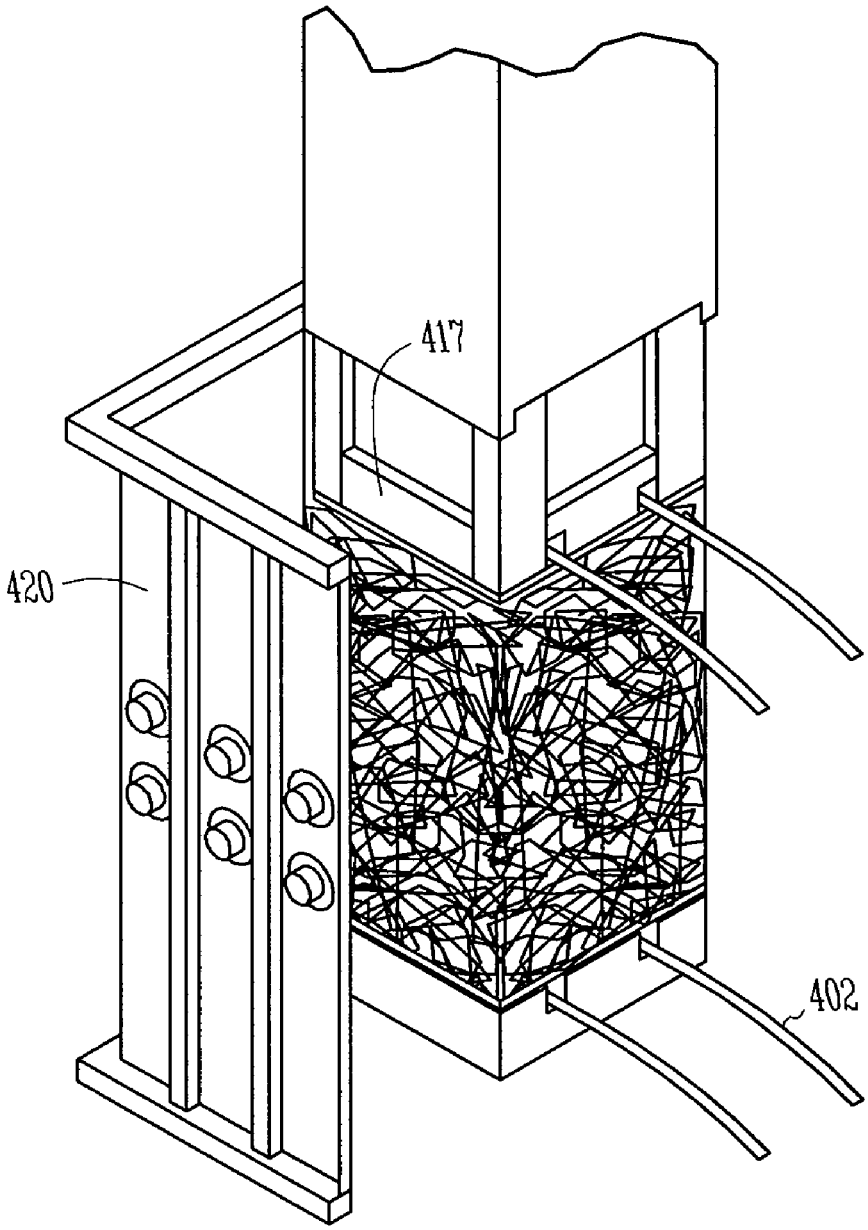
FIG. 4 shows an operator banding a bale of mulch.

After the ram has compressed the mulch, the operator opens a door of the compression chamber to band the bale. FIG. 4 shows an operator banding a bale of mulch. In the illustrated embodiment, the door 420 of the compression chamber is open and the ram 417 is visible. In various embodiments, hydraulic controls are attached to the door to assist the operator in opening and closing the door. The operator bands the bale while the ram maintains pressure on the compressed mulch. The operator slides banding material 402 through grooves in the ram to bale the mulch. As the operator inserts the banding material through the grooves of the ram, guides on the backside of the compression chamber guide the band material around the backside of the bale using slots in the bottom of the compression chamber and back toward the operator. The operator aligns the banding material and attaches a device to tighten the banding material and melt the overlapped banding material together. The operator cuts the supply end of the banding material, releases the ram pressure on the bale, and returns the ram to a position to allow the compression chamber to be filled for the next bale.

The lower surface of the compression chamber, two of the side walls of the compression chamber and the ram are slotted to allow banding straps to be threaded around the bale when the bale is compressed. In various embodiments, threading attachments are installed on one side of the compression chamber to guide banding material around the compressed volume of landscape material. In some embodiments, an automatic bander is threads the banding material and securely bands the compressed volume of landscape material.

Figure 5:
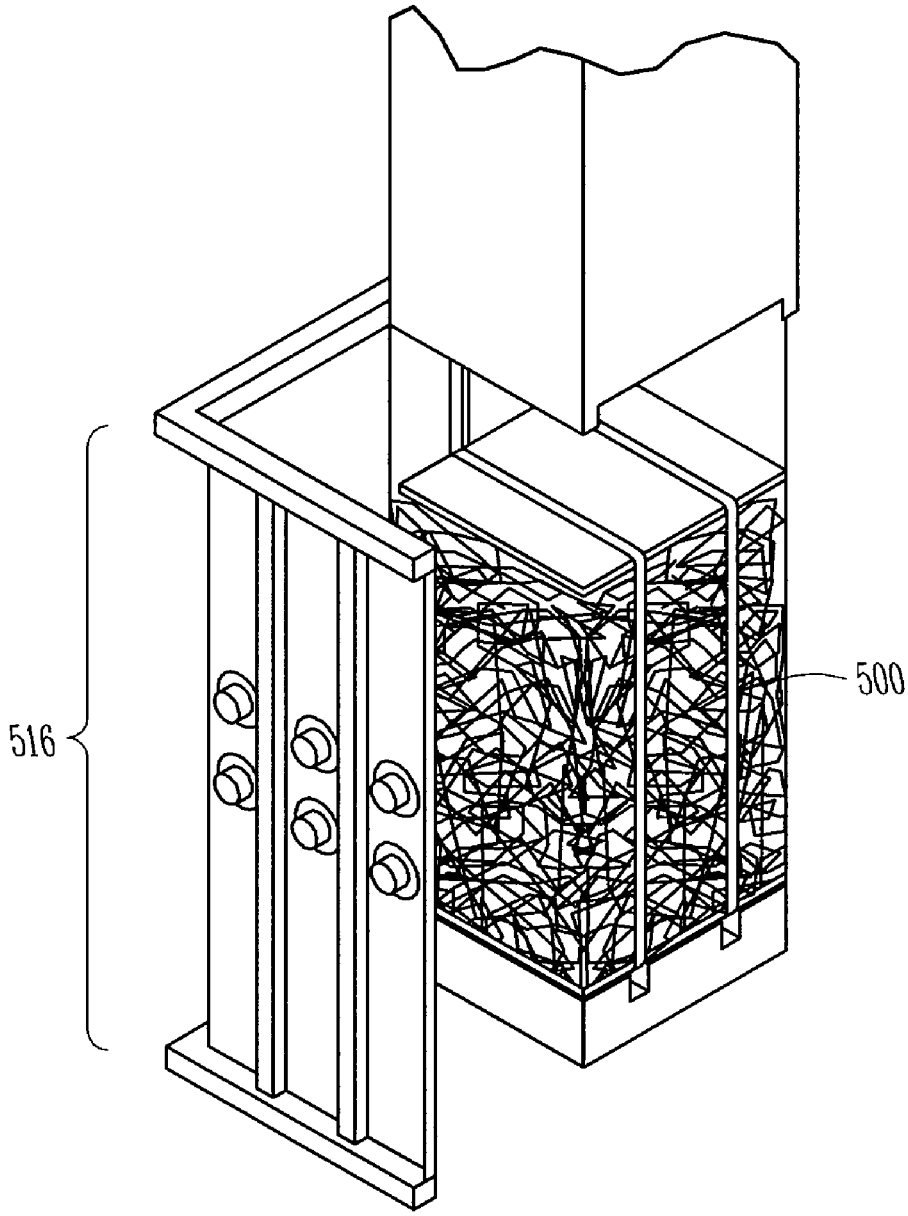
FIG. 5 shows a banded bale according to one embodiment of the present subject matter being removed from the compression chamber.
Figure 6:
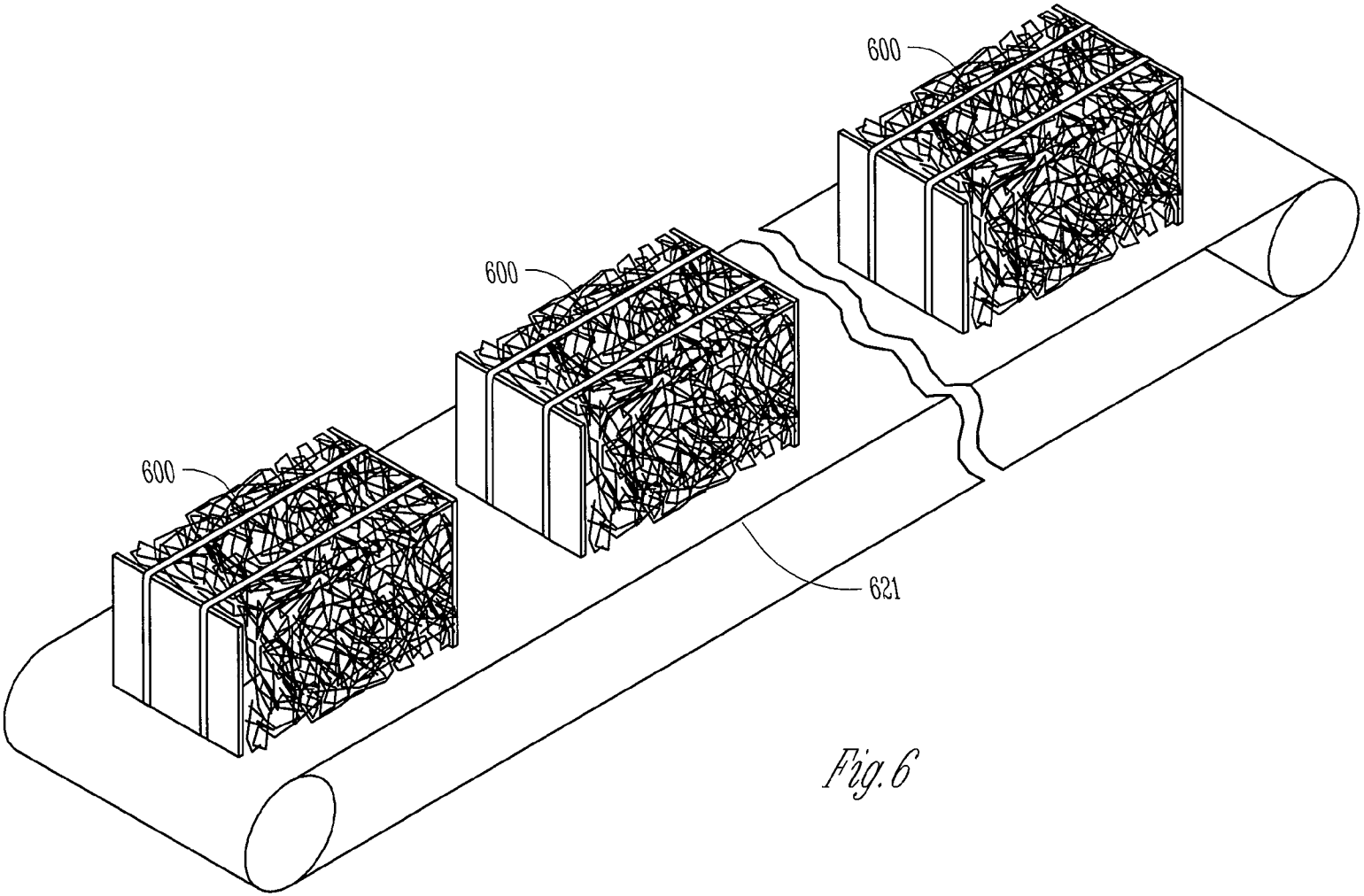
FIG. 6 shows completed mulch bales on an exit conveyor according to one embodiment of the present subject matter.

FIG. 5 shows a banded bale 500 according to one embodiment of the present subject matter being removed from the compression chamber 516. In various embodiments, completed bales are placed on an exit conveyor for transportation to another location, such as, shipping. FIG. 6 shows completed mulch bales 600 on an exit conveyor 621 according to one embodiment of the present subject matter.

Figure 7:
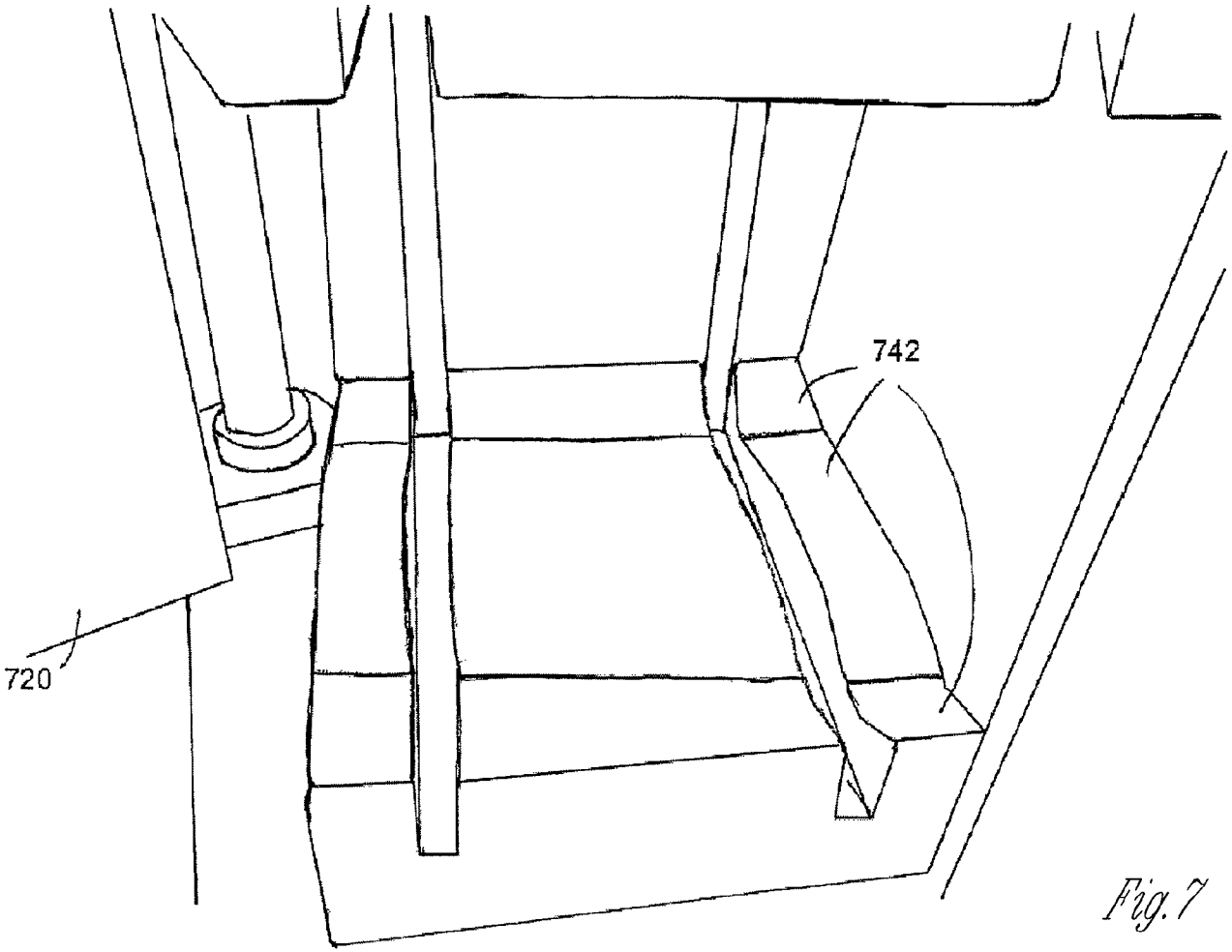
FIG. 7 shows the interior of a compression chamber of a vertical baler machine according to one embodiment of the present subject matter.

FIG. 7 shows the interior of a compression chamber of a vertical baler machine according to one embodiment of the present subject matter. A door 720 to the compression chamber is open to expose a view of the end of the baler. The end of the baler includes contours 742. In various embodiments, the ram has similar contours. The contours 742 assist in providing a cubed shape to the sheet ends of the bale after the bale is removed from the baler.

Figure 8:
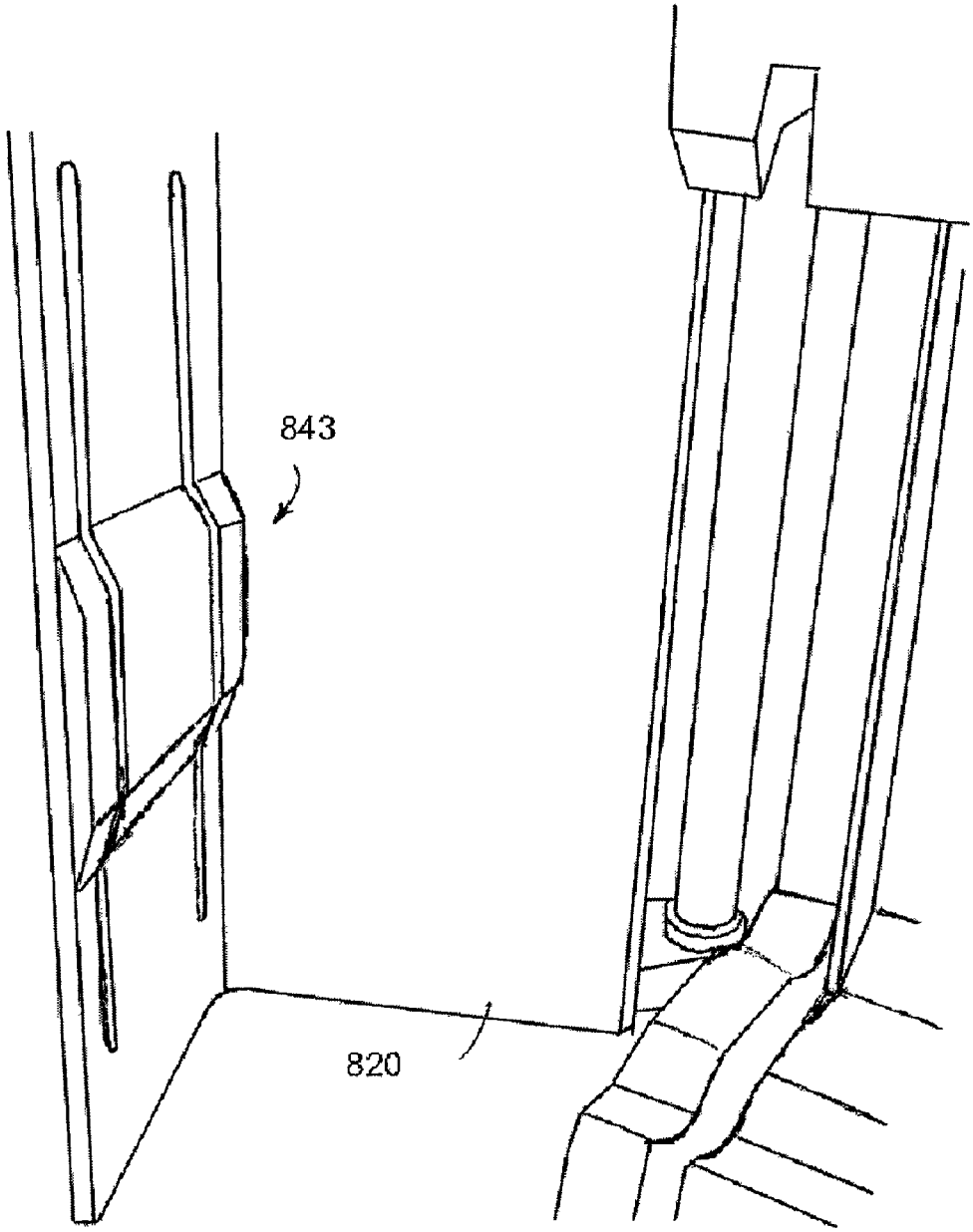
FIG. 8 shows recess contours on the interior of a compression chamber door according to one embodiment of the present subject matter.

FIG. 8 shows recess contours 843 on the interior of a compression chamber door 820 according to one embodiment of the present subject matter. Recess contours 843 are integrated in one side of the door to create voids in the mulch bale along the side of the bale where the banding material is positioned. The voids, along with the banding material, create handles in the bales to enhance the bales and reduce the loss of material when the bales are manually moved. In various embodiments, horizontal balers, such as those described below, include recess contours for creating handles in compressed bales of landscape material.

Figure 9:
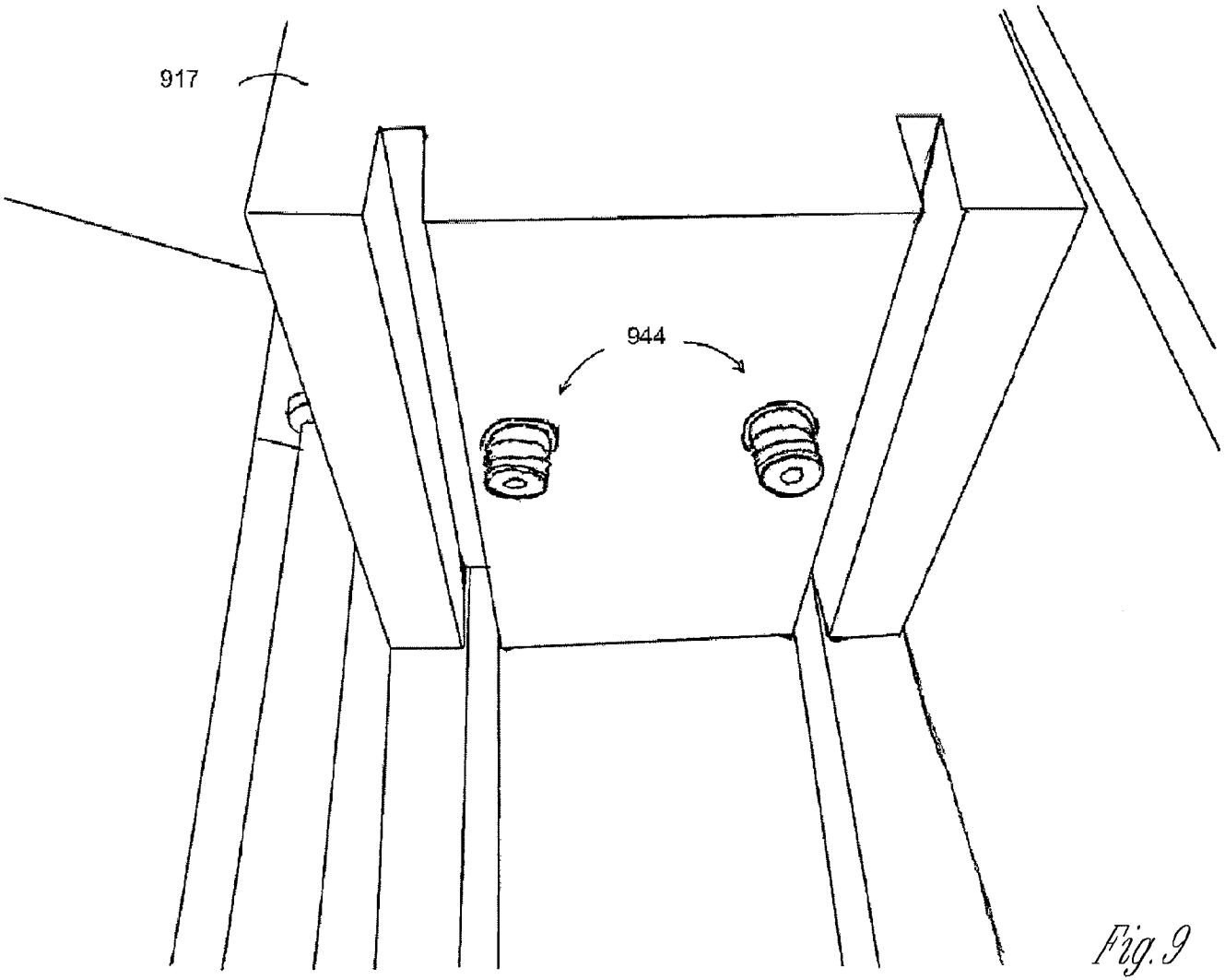
FIG. 9 shows a ram of a baler according to one embodiment of the present subject matter.

FIG. 9 shows a ram 917 of a baler according to one embodiment of the present subject matter. The ram includes two vacuum suction cups 944. The vacuum suction cups 944 are coupled to a vacuum source and the cups 944 are used to retain one of the sheets of material used to bind a bale. The suction cups 944 reduce the need for an operator to slide a piece of sheet material into the baler before the mulch is compressed as discussed above. In addition, the retainer sheet can be placed on the suction cups while the ram is exposed. The suction cups 944 hold the retainer sheet in place until the bale is compressed and banded.

Figure 10:
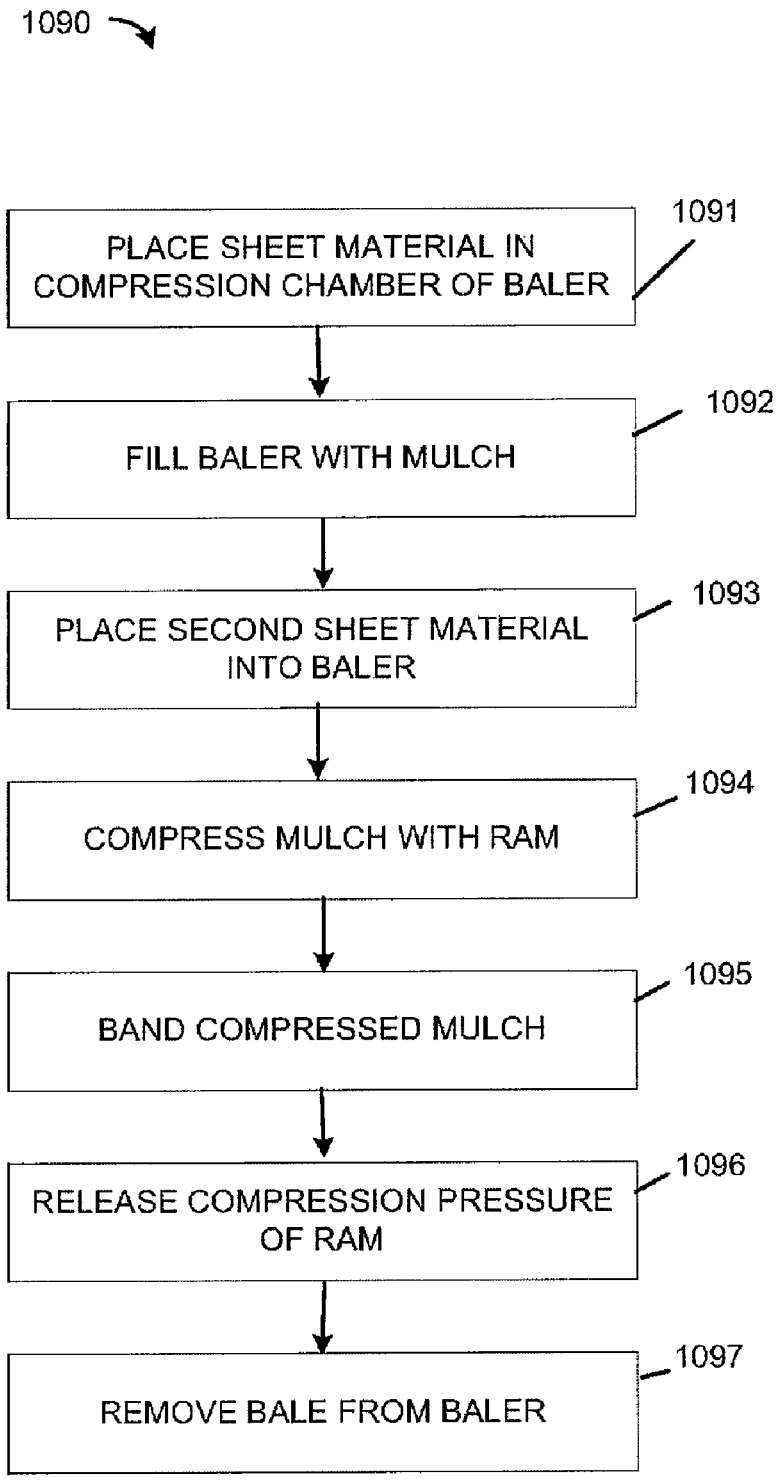
FIG. 10 shows a flow diagram of a method for making a compressed mulch bale according to one embodiment of the present invention.

FIG. 10 shows a flow diagram of a method 1090 for making a compressed mulch bale according to one embodiment of the present invention. The method includes placing sheet material into the bottom of the compression chamber 1091, loading the compression chamber with mulch 1092, adding a second piece of sheet material on top of the mulch in the compression chamber 1093, compressing the mulch with a ram 1094, banding the compressed mulch 1095 by placing strap material around the bale and securing the banding straps, releasing the ram 1096, and removing the bale 1097. In various embodiments, the compression chamber includes contours on one of the banded sides, as opposed to the banded ends including the cardboard. The contours produce indentations in the mulch bale near the banding straps. The indentations in the bale, along with the banding straps, provide handles for manually lifting and moving the bale.

Figure 11:
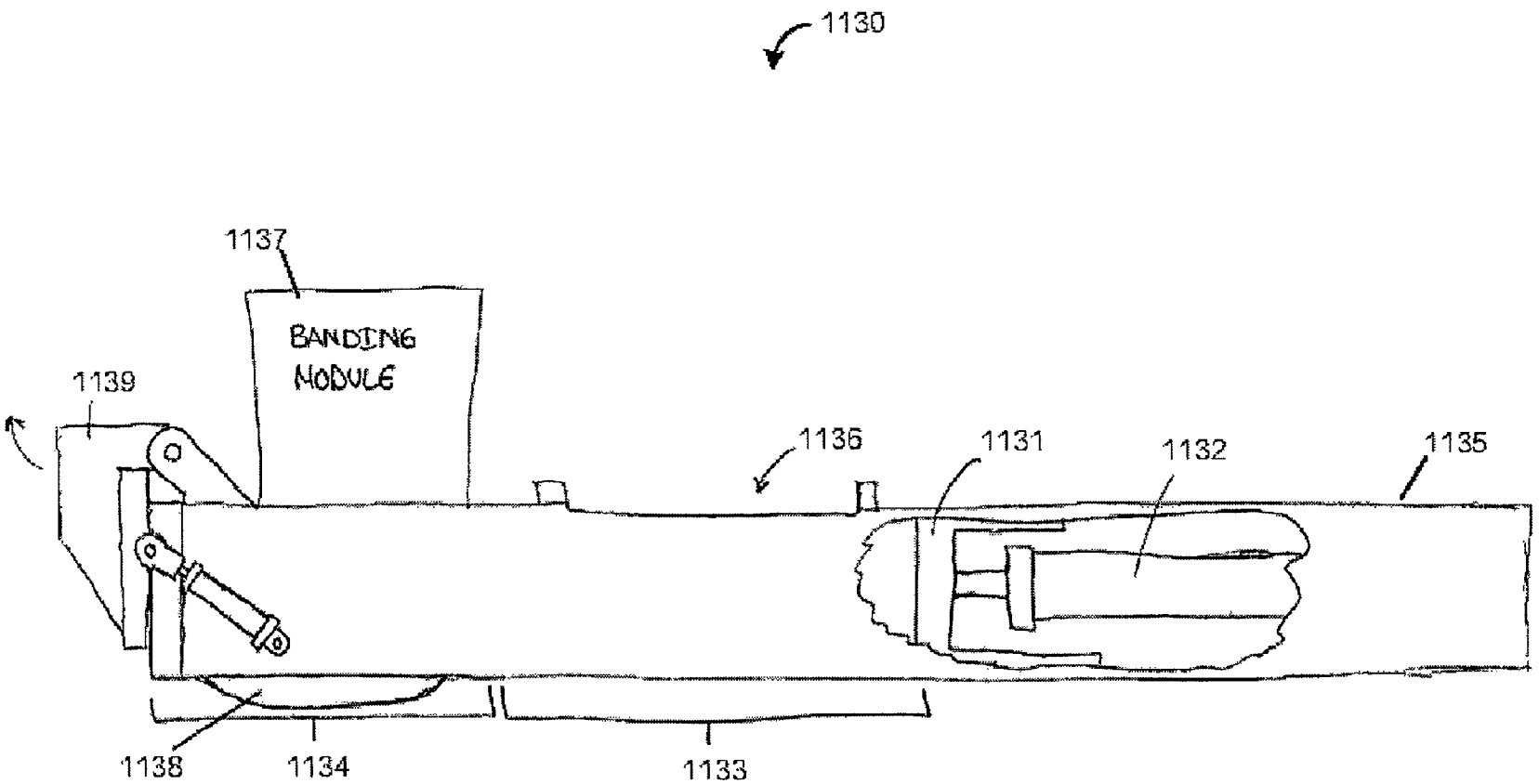
FIG. 11 illustrates an automated, horizontal baler according to one embodiment of the present subject matter.

FIG. 11 illustrates an automated, horizontal baler 1130 according to one embodiment of the present subject matter. The horizontal baler 1130 includes a ram 1131 with a hydraulic cylinder 1132, a fill chamber 1133 and a compression chamber 1134. Heavy gage tubular steel 1135 forms the compression chamber 1134 and the fill chamber 1133, and encloses the ram 1131. The fill chamber includes an opening 1136 for a feed mechanism to load mulch into the fill chamber 1133. In various embodiments, a programmable controller is connected to the baler to automate the operation of the baler 1130. In various embodiments, the controller is connected to a feed conveyor, or feed hopper and conveyor combination, to fill the chamber with a repeatable amount of mulch at each cycle of the baler. The ram 1131 compresses the mulch into the compression chamber 1134. In various embodiments, the controller controls the operation and positioning of the ram 1131 to make a properly sized mulch bale. The illustrated embodiment includes a banding machine module 1137. In various embodiments, the banding machine module automatically bands the bale when triggered by the controller. The banding machine module 1137 bands the mulch bale using the banding guides 1138 fabricated to the opposite side of the compression chamber 1134. In various embodiments, the banding machine module 1137 includes versions of banding machines well known in the art and modified to fit the horizontal baler 1130. After banding the mulch bale, a hydraulic door 1139 at the end of the compression chamber 1134 is opened to remove the bale. In some embodiments, the controller uses the hydraulic ram 1131 to push a banded mulch bale out the door 1139 before returning to a position to allow the fill chamber 1133 to be filled with mulch for the next cycle of the machine. In various embodiments, an automatic sheet feeder is used to load sheet material into the baler.

Figure 12A:
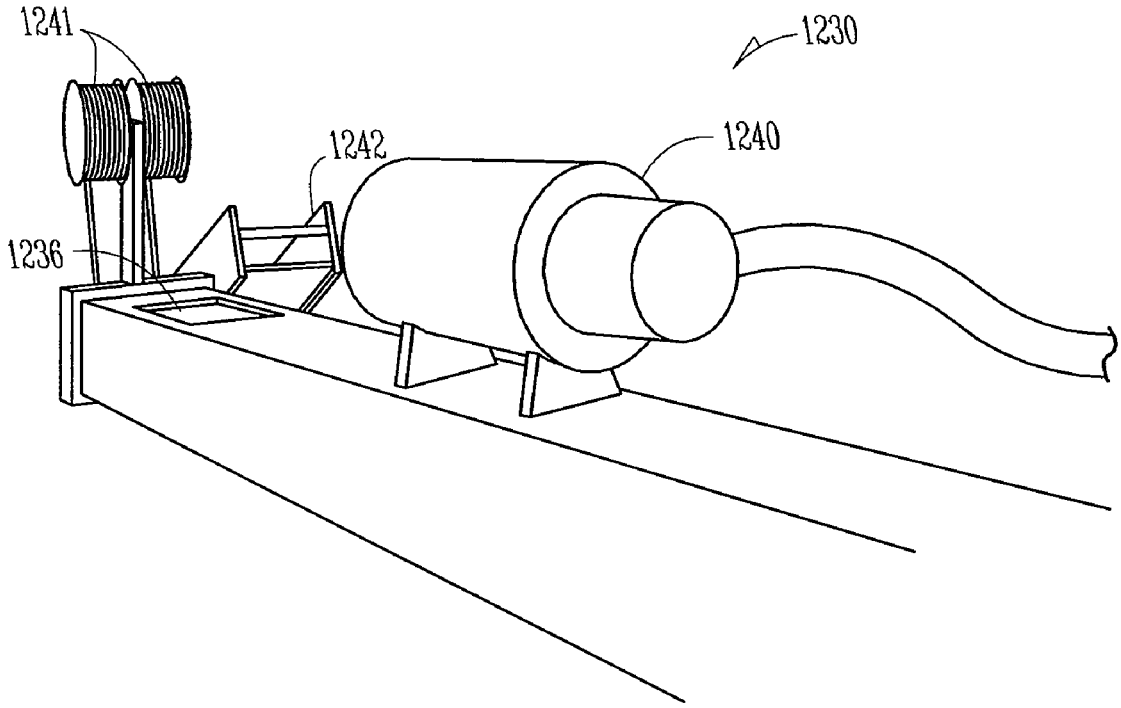
FIGS. 12A-12C shows various portions of a horizontal mulch baler according to one embodiment of the present subject matter.
Figure 12B:
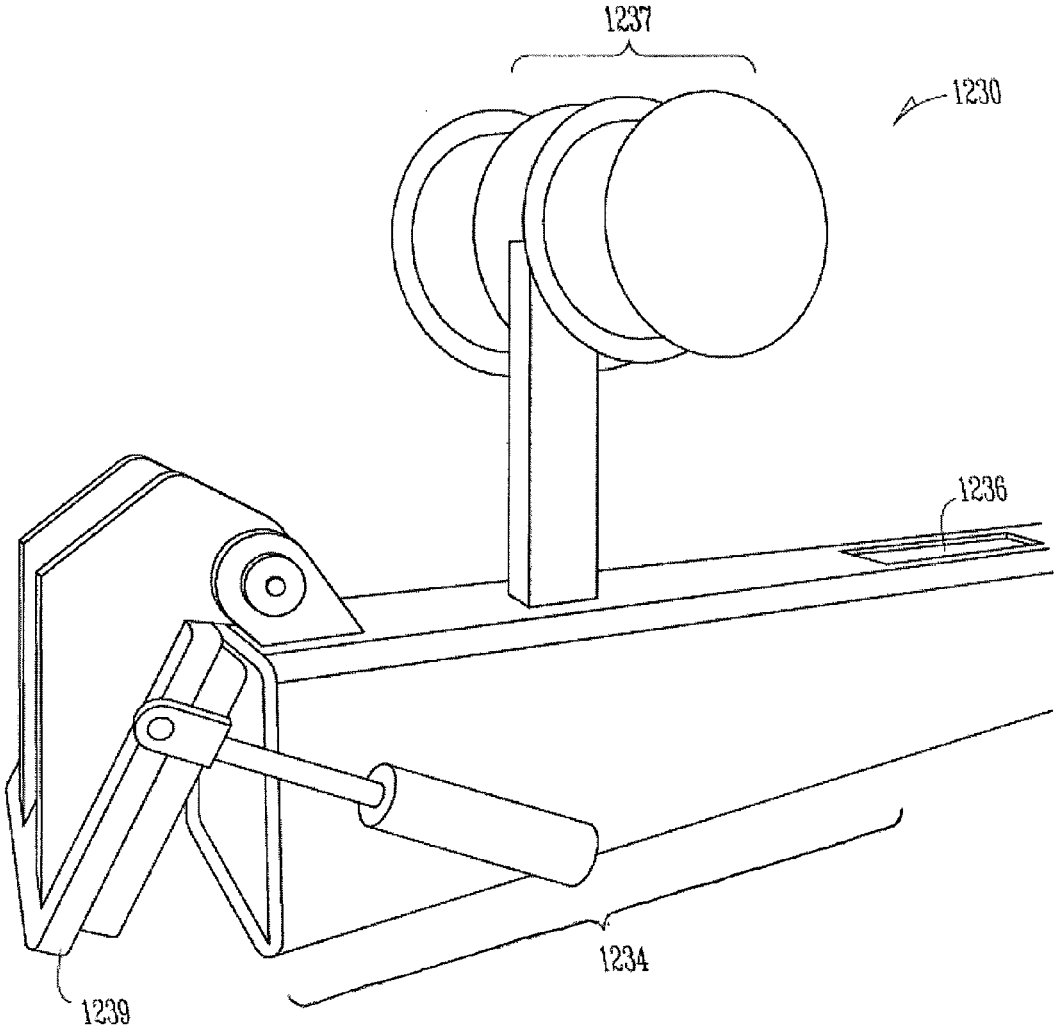
Figure 12C:
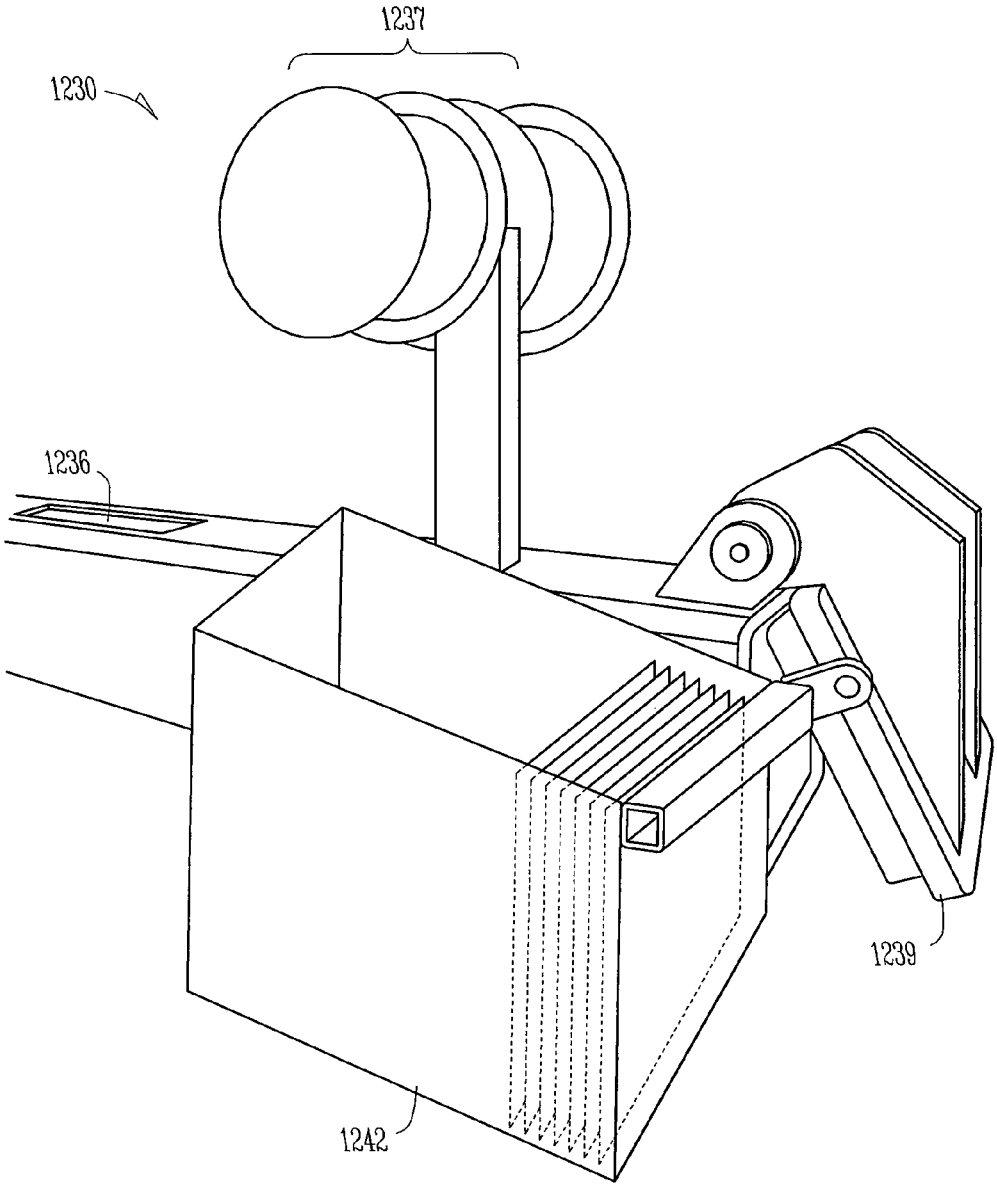

FIGS. 12A-12C shows various portions of a horizontal mulch baler according to one embodiment of the present subject matter. FIG. 12A shows the horizontal baler 1230 including a hydraulic motor and pump 1240, an access opening 1236 for loading mulch in to the baler, banding material 1241 for a banding module and a portion of an automatic sheet feeder 1242.

FIG. 12B shows the horizontal baler 1230 including the compression chamber 1234, the fill access opening 1236, the compression chamber door 1239 with an attached hydraulic cylinder and a portion of the bander module 1237.

FIG. 12C shows the horizontal baler including the bander module 1237, a portion of the compression chamber door 1239 and a portion of the automatic sheet feeder 1242.

Figure 13B:
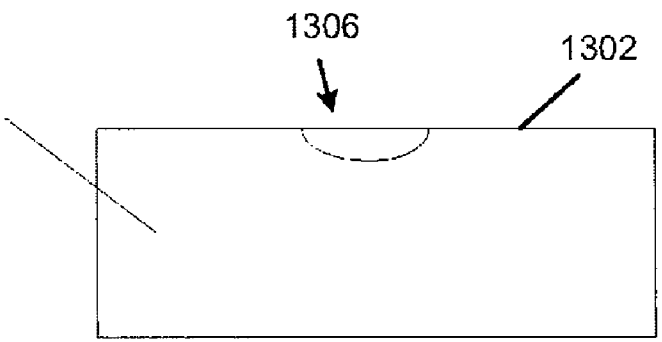
FIGS. 13A and 13B show a bale of compressed landscape material according to one embodiment of the present subject matter.
Figure 13A:
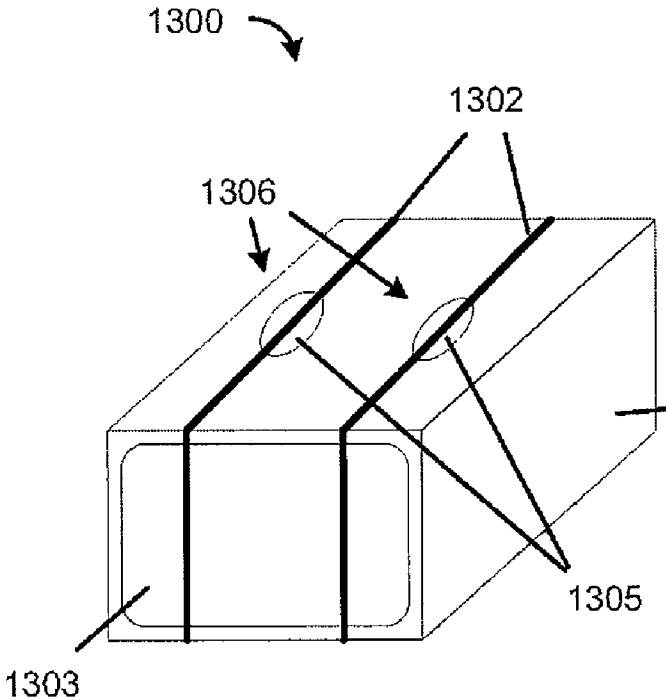

FIGS. 13A and 13B show a bale 1300 of compressed landscape material according to one embodiment of the present subject matter. The bale 1300 includes a volume of compressed landscape material 1301, banding 1302 to maintain the compressed landscape material, handles 1306 for manually transporting the bale, and retaining sheets 1303 at each end of the bale. The handles of the bale are formed using recesses 1305 in the bale positioned under the banding 1302. A recess allows a person to grab the banding to lift and move the bale. The landscape material is highly compressed, thus, making it difficult to indent the surface of the bale manually. In various embodiments, the bales are sized and shaped to allow an average healthy adult to easily lift and move the bale by hand. In some embodiments, the bale measures about 15 inches high by about 15 inches deep and about 18 inches long. Such a bale includes about 6.5 cubic feet of uncompressed landscape material. In some embodiments, the bale measures about 14" high, about 14 inches deep and about 16 inches long and includes about 4.5 cubic feet of uncompressed landscape material. Depending on size and moisture content, the bales of compressed cedar mulch are configured to weigh between about 20 pounds to about 45 pounds. It is understood that other bale size and shapes are possible without departing from the scope of the present subject matter.

The banding material 1302 holds the compressed landscape material together. The illustrated bale 1300 includes bands separated by a distance and extending parallel to each other around the length of the bale. The bands can include various materials, including but not limited to, string, twine, rope, polyester, and polypropylene. In some embodiments, the banding material has a break strength of at least about 1200 pounds. In various embodiments, the two bands are separated by about 7 inches to about 9 inches. In various embodiments, the plastic bands have a width of about ⅝ inch and are recyclable. Plastic banding materials include, but are not limited to, polyester and polypropylene. It is understood that a bale includes at least one band to maintain the compressed volume of landscape material. Bales including more bands are possible without departing from the scope of the present subject matter.

FIG. 13B shows a bale cross-section. The cross-section is bounded by the banding material 1302 and shows a handle recess 1306 extending in to the compressed landscape material 1301. In various embodiments, the handle recess 1306 extends into the compressed landscape material to a depth of about 1 inch to about 4 inches.

The retaining sheets 1303, positioned at the ends of the bales, assist in maintaining the bales. The retaining sheets distribute the pressure between the compressed landscape material and the banding over a greater area, thus, reducing the tendency of the banding material to dig into the landscape material. In various embodiments, the retaining sheets 1303 include a double ply edge around the sheet. The double ply edge strengthens the edge of the retaining sheet and resists tearing where the banding extends from the retaining sheet. In some embodiments, the double ply edge is formed by cutting off the comers of a larger single ply sheet at 45-degree angles and then folding each of the sides of the single ply over onto itself and stapling or gluing the two layers together. The retaining sheets also provide an area to print information about the bale including, but not limited to, labeling identifying the materials, the size of the bale and barcodes.

Figure 14A:
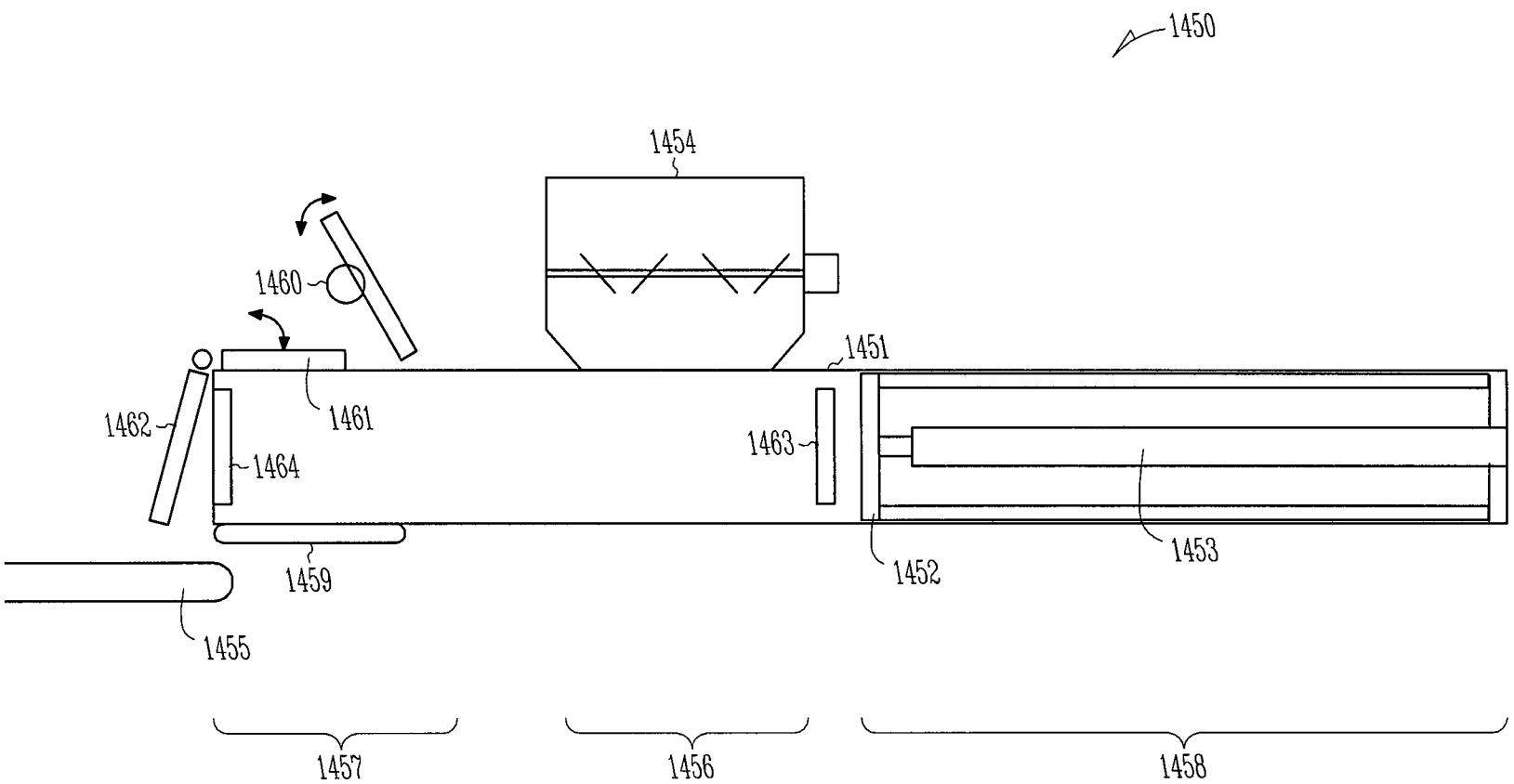
FIG. 14A shows a horizontal baler system according one embodiment of the present subject matter.

FIG. 14A shows a horizontal baler 1450 system according one embodiment of the present subject matter. The baler includes a ram tube 1451, a ram 1452 enclosed in the ram tube and coupled to a hydraulic cylinder 1453, a pre-fill chamber 1454, and an exit conveyor 1455. The ram tube 1451 houses the ram 1452. In various embodiments, the tube 1451 is lined with a material to eliminated metal-to-metal contact between the ram 1452 and the ram tube 1451. Polycarbonate is one example of material that may be used to line the ram tube 1451. Such materials reduce the maintenance of the system and extend the life of the tube and the ram. The ram tube include a fill section 1456, a compression section 1457, and a retract section 1458. The ram includes a face and a shell. The ram 1452 is sized and shaped to conform to the interior of the tube such that landscape material is substantially prohibited from passing from one side of the ram face to the other between the ram and the tube. In operation, a hydraulic system is connected to the ram 1452 through the hydraulic cylinder 1453. The hydraulic system moves the ram back and forth inside the ram tube 1451. During a cycle to make a bale of landscape material, the ram 1452 is retracted to allow landscape material to be loaded into the tube. In various embodiments, retainer sheets are loaded into the ram tube through slots 1463, 1464 in the side of the ram tube 1451. One slot 1463 is located near the retracted position of the ram, and the other retainer sheet slot 1464 is located near the end of the compression chamber. The ram is then driven through the fill section 1456 to compress the landscape material loaded into the ram tube. In various embodiments, the hydraulic cylinder 1453 driving the ram is a 4-inch cylinder and the hydraulic system will drive the cylinder with between about 1000 psi to about 3200 psi of hydraulic pressure to compress the landscape material. It is understood that other cylinder sizes and operating pressures are possible without departing from the scope of the present subject matter.

A system controller stops the ram at a predetermined location to form a bale of landscape material of a predetermine length. Additionally, the system controller stops the ram at a position that aligns banding groves in the ram 1452 with banding guides 1459 coupled to the walls of the ram tube 1451 at the compression section 1457. The compression section 1457 of the ram tube 1452 includes banding slots to band the compressed landscape materials into a bale. The slots extend in the direction of the ram travel and are located on two opposing sides of the ram tube. An end of the compression section opposite of the ram, as well as the ram itself, also include banding slots. The slots are aligned to allow banding material to circumscribe the compressed landscape material while the material is held captive in the compression section 1457. In various embodiments, one side of the ram tube includes banding guides 1459. The banding guides 1459 guide banding material around the compressed landscape material by simply inserting the banding material through a slot at one end of the compression chamber 1457 and retrieving it from a slot at the opposite end of the compression chamber. Upon retrieving the threaded end of the banding material, a banding machine or an operator can easily grab the threaded end of the banding material and complete the banding of the compressed landscape material.

In various embodiments, before banding the compressed volume of landscape material, recesses for handles are formed by removing landscape material through the banding slots in the ram tube. In some embodiments, the recesses for the handles are formed using a grinder 1460. The grinder 1460 is coupled to the ram tube 1451. Upon compressing a volume of landscape material, covers 1461 covering the banding slots are pivotally removed. Upon removal of the covers 1461, the grinders 1460 are pivoted to engage and remove the compressed landscape material to form the handle recesses. In various embodiments, the grinder 1460 includes a vacuum hood to recover removed material for reuse. In some embodiments, the grinder 1460 includes two grinding wheels such that two handle recesses can be formed simultaneously.

After the handle recesses are ground into the compressed volume of landscape material, the compressed volume of landscape material is banded as described above. Upon banding the compressed volume of landscape material, the bale is ejected from the ram tube and the ram is retracted in preparation for processing the next bale. The bales are ejected from the ram tube through an exit door 1462 at the end of the compression chamber 1457. Ejecting the bale includes opening the exit door 1462 and using the ram 1452 to push the bale out the end of the ram tube 1451. The bale rolls along an exit conveyor 1455 to be stacked for distribution. In various embodiments, the exit door 1462 is operated with a hydraulic cylinder. In some embodiments, opening the exit door 1462 re-positions the slot covers 1461 over the banding slots of the ram tube in preparation for processing the next bale of landscape material. Upon closing the exit door 1462, the slot covers 1461 are spring loaded against a latch while covering the banding slots. Upon completion of the next compression cycle, the latch is released to pivot the slot covers and expose the slots for grinding the handle recesses and banding the bale.

Figure 14B:
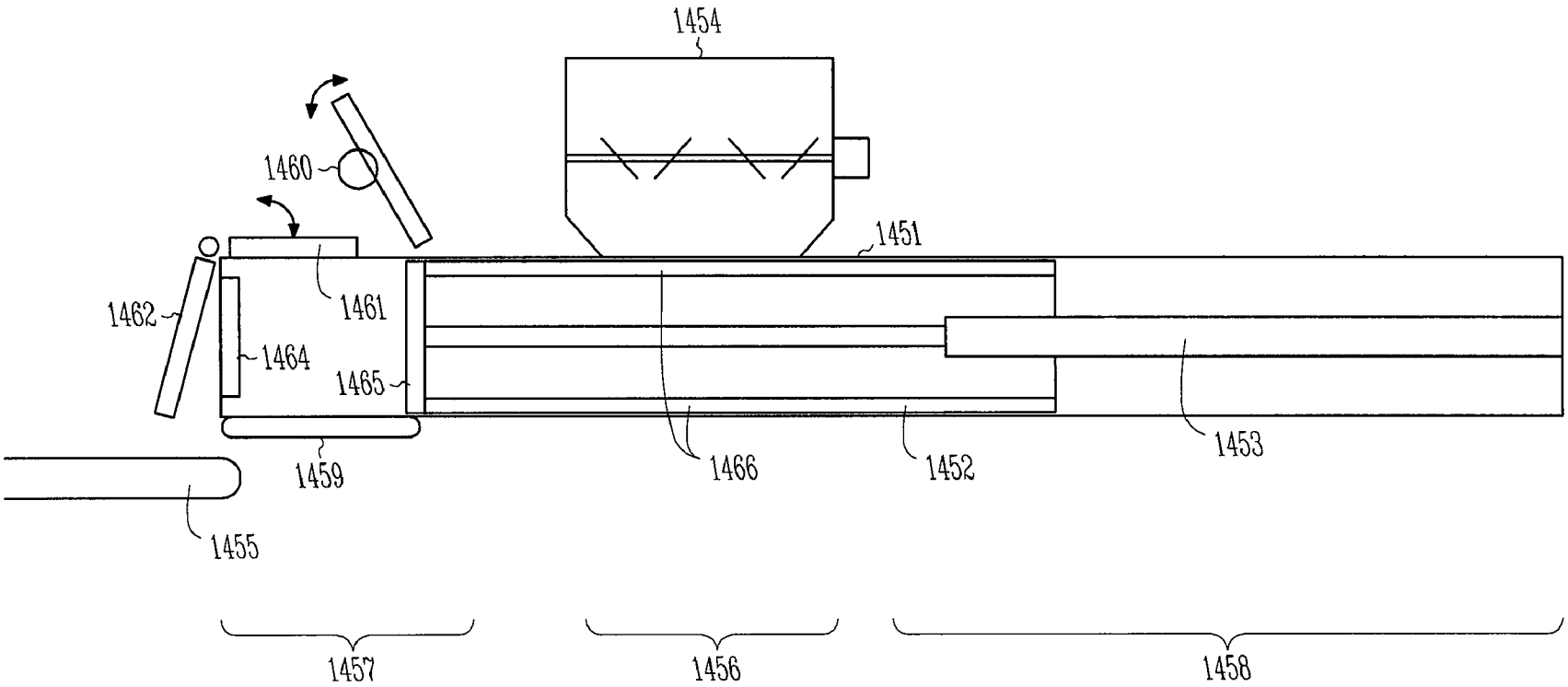
FIG. 14B shows a cutaway view of a baler according to one embodiment of the present subject matter.

In some embodiments, the construction of the ram facilitates not only compressing and banding the bales but also allows the baling to be executed efficiently. FIG. 14B shows a cutaway view of a baler according to one embodiment of the present subject matter. The ram includes a face portion 1465 and a shell portion 1466. The shell portion 1466 extends behind the face 1465 of the ram 1452. In various embodiments, the shell 1466 closes off the ability of the landscape material to be loaded into the ram tube 1451 when the ram is positioned beyond the retract position toward the compression chamber, such as when the ram is compressing a volume of landscape material, maintaining the compressed volume of landscape material while the handle recesses are formed and the bale banded, and when the ram is ejecting a completed bale. During these times, a loading conveyor can fill the pre-fill chamber 1454 in preparation for the next cycle. In some embodiments, the pre-fill chamber 1454 is filled using a sensor to detect when the chamber is full. While the ram is compressing, holding or ejecting a bale of landscape material, the ram shell 1466 prevents the preloaded material from entering the ram tube behind the ram face. As the ram retracts from ejecting a bale of landscape material, the preloaded material falls into the tube and the next cycle can commence immediately.

Figure 14C:
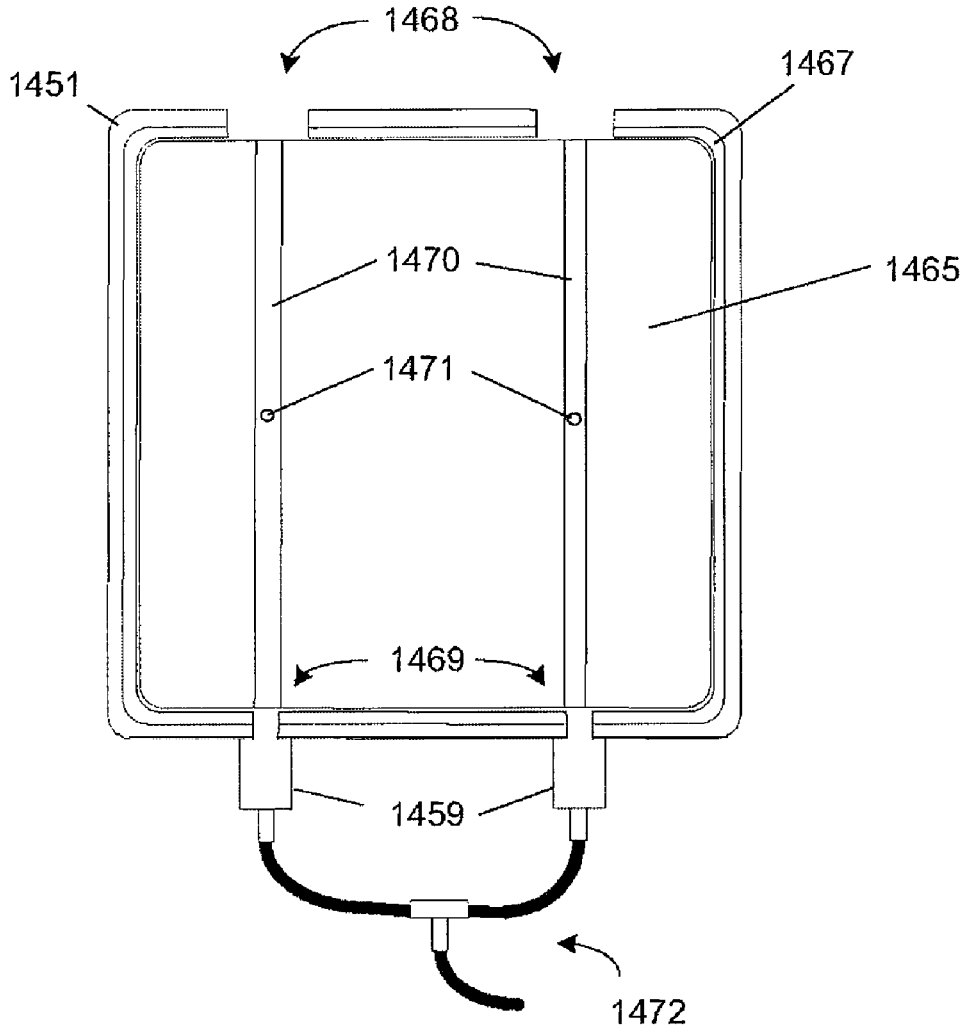
FIG. 14C shows a cross-section of the compression chamber according to one embodiment of the present subject matter.

FIG. 14C shows a cross-section view of the compression chamber according to one embodiment of the present subject matter. The cross section shows a heavy gage metal tube 1451, a polycarbonate material liner 1467, the face of the ram 1465 within the tube, a first set of banding slots 1468 in a wall of the tube, a second set of banding slots 1469 in an opposite wall of the tube, and banding guides 1459 coupled to the wall of the tube near the second set of banding slots 1469. The first set of banding slots 1468 are substantially wider than the second set of banding slots 1469 to accommodate a grinder. The grinder removes material to create handle recesses that work in cooperation with the banding to form handles for manually transporting the bales of compressed landscape materials. Banding the compressed volume of landscape materials include threading banding straps through the banding slots 1470 of the ram 1465 from the first set of banding slots 1468 to the second set of banding slots 1469. The banding guides 1459 direct an threaded end of the banding straps to the other end of the compressed volume of landscape material and through the banding slots in the end (not shown) of the compression chamber from the second set of banding slots 1469 back to the first set of banding slots 1468. Upon reemerging from the banding slot of the end of the compression chamber, the threaded end of the strap is pulled tight and secured to the tail of the strap to bind and form a bale of landscape material. It is understood that banding can also start with threading the banding strap through the banding slots of the end of compression chamber first. In various embodiments, compressed air 1471 is coupled to the banding slots of the ram 1465 and the slots in the end of the compression chamber to clear the banding slots of loose landscape material before and during the banding process. In some embodiments, compressed air 1472 is also coupled to the banding guides 1459 to keep the banding guides clear of loose debris.

Figure 15:
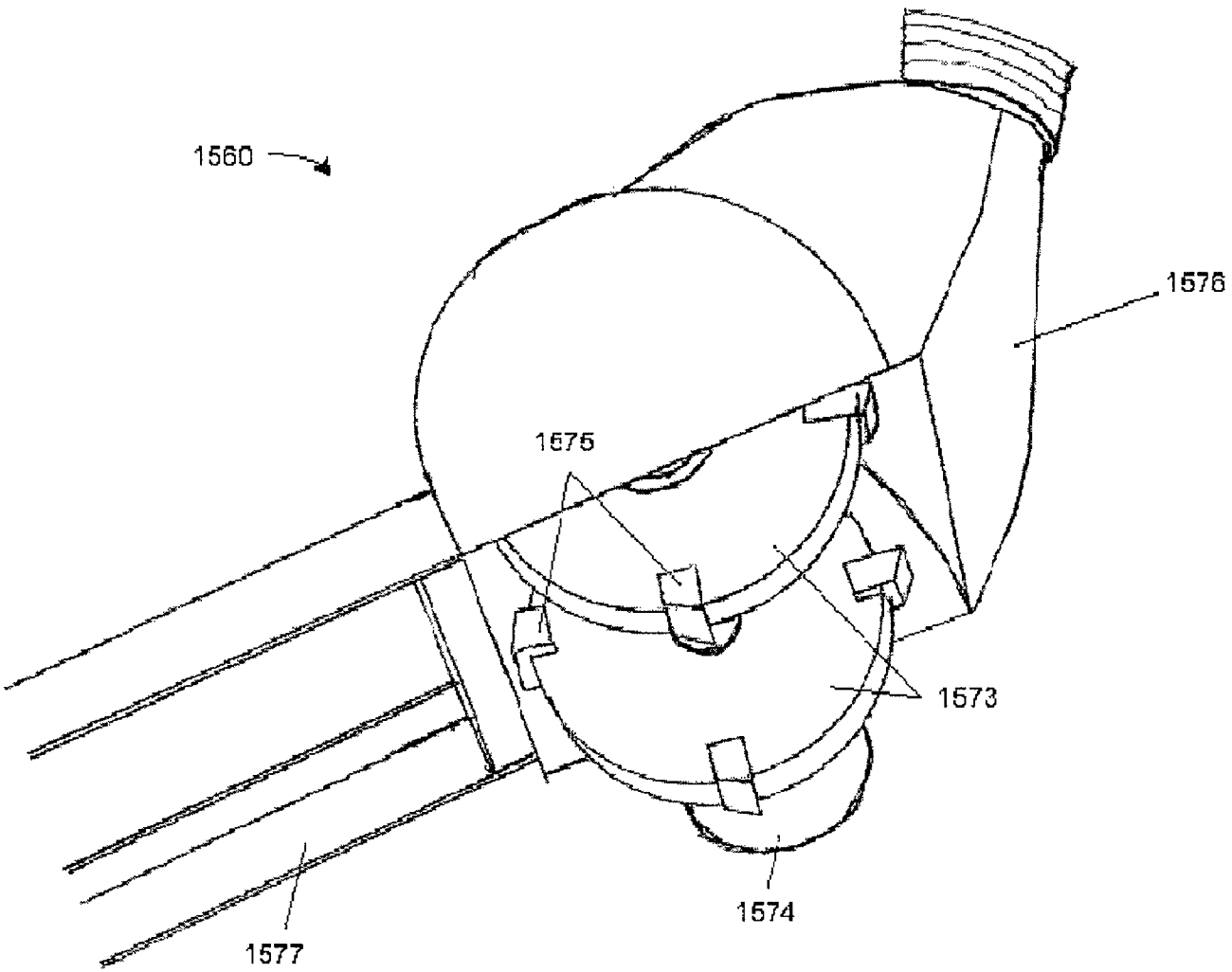
FIG. 15 shows a grinding machine for forming handle recesses according to one embodiment of the present subject matter.

FIG. 15 shows a grinding machine 1560 for forming the handle recesses according to one embodiment of the present subject matter. The grinding machine 1560 includes two grinding wheels 1573 connected by an axel. The axel is driven by a motor 1574. In various embodiments, the motor 1574 is a hydraulic motor and is driven from the same hydraulic pressure source driving the ram cylinder. The grinding wheels each include bit inserts 1575. The bit inserts 1575 perform the grinding of the landscape material. In some embodiments, the grinding wheels are about 6 inches in diameter to about 9 inches in diameter. In various embodiments, the grinding face of a bit is about 2 inches wide and about ⅝ inches deep. The illustrated embodiment includes four bits on each wheel. It is understood that other diameters and bit wheel patterns are possible with out departing from the scope of the present subject matter. In various embodiments, the grinding machine 1560 includes a vacuum hood 1576. The vacuum hood 1576 is connected to a vacuum source and collects landscape materials as the grinder engages the compressed landscape materials. The vacuum hood reduces airborne particles and collects the removed landscape materials for reuse. A frame 1577 for pivotally connects the grinding machine to the tube. The pivot connection allows the grinding machine to easily engage and grind the compressed volume of landscape material through the banding slots of the tube when needed and to pivot clear of the banding slots when not needed.

Figure 16:
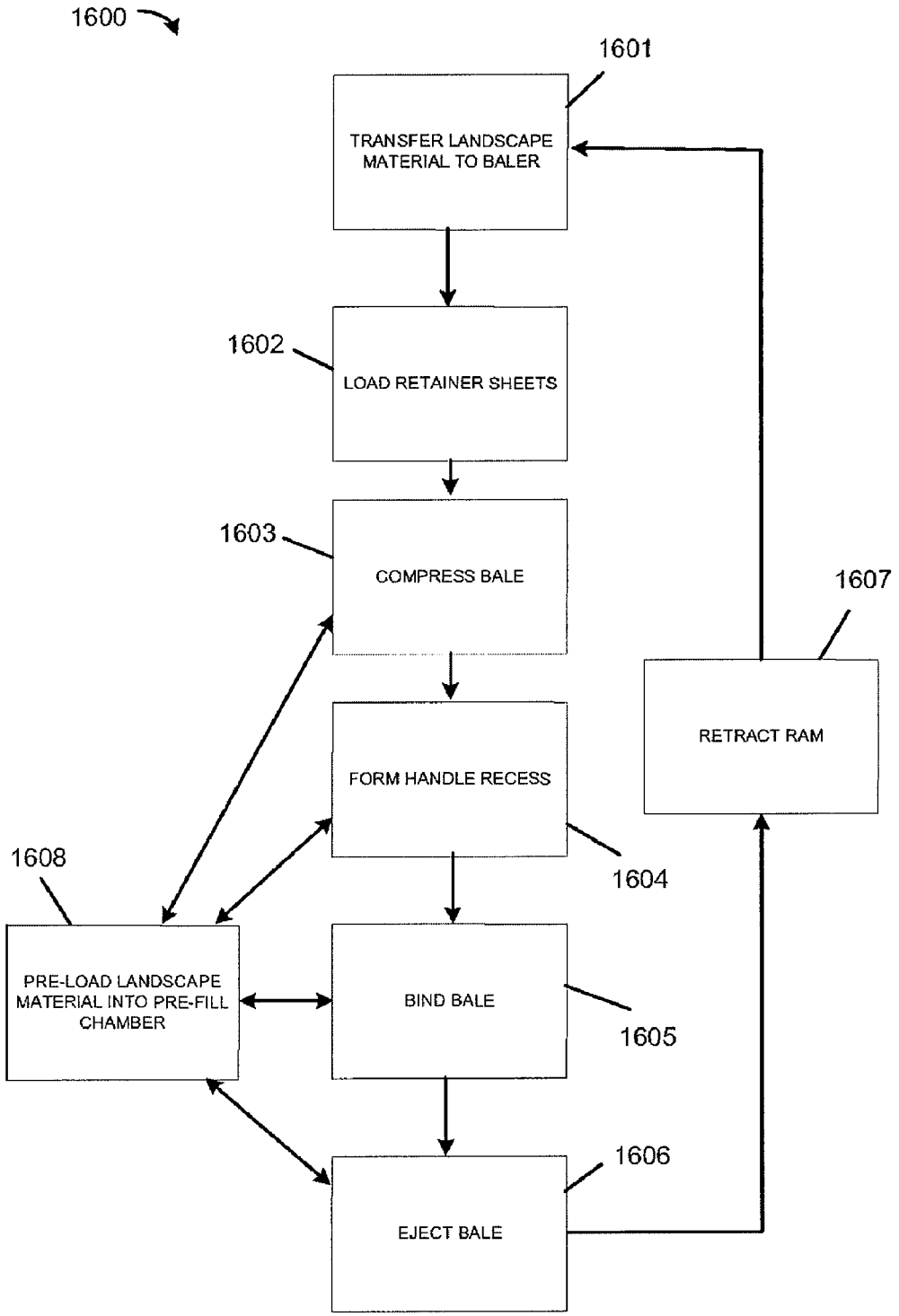
FIG. 16 shows a method for making a compressed bale of landscape material according to one embodiment of the present subject matter.

FIG. 16 shows a method 1600 for making a compressed bale of landscape material according to one embodiment of the present subject matter. The method includes loading the landscape material into the ram tube from a pre-fill chamber 1601, loading a retaining sheets 1602, one at the end of the compression chamber and one near the face of the ram, compressing the landscape material 1603, forming handle recesses 1604, banding the bale 1605, ejecting the bale 1606, and retracting the ram 1607. In various embodiments, landscape material for a subsequent bale can be pre-loaded into the pre-fill chamber 1608 while the ram is holding the compressed volume of landscape material in the compression area or ejecting a completed bail. The ram shell prevents the material from falling into the ram tube prematurely. As the ram face retracts past the pre-fill area, the material falls into the ram tube and the next bale can immediately start to be compressed.

The present subject matter provides compact wood mulch bales that, in various embodiments, can be hand loaded and carried to a workplace destination. The compressed wood mulch bales can provide a more efficient, hand portable, packaging than traditional wood mulch packaging. These bales allow for efficient transportation since they are a dense package of the wood mulch. They can be hand carried to a desired destination. The bales can be distributed around a worksite and the band or bands can hold the bale under compression for an indefinite amount of time. The band or bands can be cut when the bale is ready for distribution around the destination. Thus, the present subject matter provides for fewer back and forth trips for bales delivered to a workplace due to the compact nature of the bale. The bales also allow for hand carrying if desired, to avoid having machinery cross a current landscape. The bales also allow for distribution of the mulch about a destination site without numerous wheelbarrow trips or the use of other heavier machinery to distribute the wood mulch. The bales also allow for relatively inexpensive and/or ecological packaging of wood mulch.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. A bale of wood mulch prepared by a method comprising:

compressing wood mulch at a pressure of between 12,000 pounds and 60,000 pounds to a volume of about 14 to 15 inches by about 14 to 15 inches by about 16 to 24 inches to form a volume of compressed wood mulch;

placing a first cardboard sheet on a first end of the compressed volume and a second cardboard sheet on a second end of the compressed volume;

disposing at least a first band about the first cardboard sheet, the second cardboard sheet and the compressed volume of wood mulch, the first band being substantially thinner than the compressed volume of wood mulch;

forming a recess in the compressed wood mulch under the area of at least the first band to provide a handle for carrying the bale of wood mulch, wherein the compressed volume of wood mulch is between about 3000 cubic inches and about 5400 cubic inches.

2. The bale of claim 1, wherein the bale is a rectangular cube shape and includes a substantially square cross-section, the substantially square cross section having a height of between 14 and 15 inches and a width of between 14 and 15 inches.

3. The bale of claim 2, wherein the bale has a length of between about 16 inches and about 24 inches, the length measured perpendicular to the substantially square cross section.

4. The bale of claim 1, wherein the recess extends to a depth of about 1 inch to about 4 inches into the compressed volume of wood mulch.

5. The bale of claim 4, wherein providing a recess includes compression molding the recess in a surface of the compressed volume of wood mulch.

6. The bale of claim 4, wherein providing a recess includes removing a portion of the compressed volume of wood mulch.

7. The bale of claim 1, wherein the first and second cardboard sheets are adapted to provide an area for printed information.

8. The bale of claim 1, wherein disposing at least a first band includes disposing a band including recyclable plastic.

9. The bale of claim 1, wherein disposing at least a first band includes disposing a band having at least a 1200 pound break strength.

10. The bale of claim 1, wherein the method further comprises disposing a second band about the compressed volume of wood mulch.

11. The bale of claim 10, wherein the second band is substantially thinner than the compressed volume of wood mulch.

12. The bale of claim 11, wherein the first band is about ⅝" wide strap.

13. The bale of claim 10, wherein the first and second bands are about ⅝" wide straps.

14. The bale of claim 1, wherein the method further comprises printing on one or more of the first and second cardboard sheets.

15. The bale of claim 14, wherein the printing includes printing the size of the bale.

16. The bale of claim 14, wherein the printing includes printing barcodes.

17. The bale of claim 14, wherein the printing includes printing labeling identifying the materials.

18. The bale of claim 1, wherein the first and second cardboard sheets are square or rectangular.

19. The bale of claim 18, wherein the first and second cardboard sheets are folded to add strength and reduce water entry to the compressed volume of wood mulch.

20. The bale of claim 14, wherein the first and second cardboard sheets are folded to add strength and reduce water entry to the compressed volume of wood mulch.

* * * * *